United States Patent [19]

Zwagerman

[11] Patent Number: 4,596,336

[45] Date of Patent: Jun. 24, 1986

[54] MOBILE CRANE

[76] Inventor: Jan Zwagerman, Middenweg 127a, 1394 AG Nederhorst den Berg, Netherlands

[21] Appl. No.: 634,878

[22] Filed: Jul. 26, 1984

[30] Foreign Application Priority Data

Jul. 28, 1983 [NL] Netherlands ..... 8302687

[51] Int. Cl.[4] ..... B66C 23/42

[52] U.S. Cl. ..... 212/184; 212/199; 212/262; 212/203

[58] Field of Search ..... 212/202, 203, 204, 184, 212/199, 262, 239, 182

[56] References Cited

U.S. PATENT DOCUMENTS 1,023,006 4/1912 Carriker ..... 212/199

FOREIGN PATENT DOCUMENTS 1247584 8/1967 Fed. Rep. of Germany ..... 212/184

966295 10/1950 France ..... 212/183

1204760 1/1960 France ..... 212/204

175997 7/1961 Sweden ..... 212/183

332946 11/1958 Switzerland ..... 212/239

394418 6/1933 United Kingdom ..... 212/204

*Primary Examiner*—Robert J. Spar

*Assistant Examiner*—Michael Stone

*Attorney, Agent, or Firm*—Pahl, Lorusso & Loud

[57] ABSTRACT

According to the invention a extendible and retractable luffing jib (13) is hingedly supported by a main boom (10,25) which can be positioned in a horizontal position, which luffing jib (13) protrudes at its rear side over some distance beyond the main boom (10,25), whereby a first block of sheaves (15) is fitted on the main boom (10,25) at a lower level than the luffing jib (13) while wire ropes (19,20) are reeved between these sheaves (15) and a second block of sheaves (14) mounted on the rear end of the luffing jib (13) for luffing the luffing jib (13) as well as for hoisting.

11 Claims, 7 Drawing Figures

MOBILE CRANE

The invention relates to a mobile crane with a main boom or mast, which can be brought in an upward position on a crane substructure.

It is the object of the invention to provide such a mobile crane, which can be used for many different purposes and which can replace for example a tower crane with travelling trolley or a conventional crane with luffing telescopic mast and is nevertheless easy to erect and which may be swung down for transport on a mobile crane substructure.

For this purpose the mobile crane according to the invention is characterized by an extendible and retractable luffing jib which is hingedly supported by the main boom and which can be positioned in a horizontal position, which luffing jib protrudes at its rear side over some distance beyond the main boom, whereby a first block of sheaves is fitted on the main boom at a lower level than the luffing jib while wire ropes are reeved between these sheaves and a second block of sheaves mounted on the rear end of the luffing jib for luffing the luffing jib as well as for hoisting.

With this construction it is achieved that the dead angle of an oblique boom supported on the crane substructure disappears, while on the other hand the space between the main boom and the luffing jib is completely free, so that the crane, when used as a tower crane, can be placed quite near the building under construction. This is particularly important when little room is available for manoeuvring the crane on the building site. With the construction according to the invention the luffing jib can be luffed over a great angle and can also be placed under a negative angle. Because of the absence of a counterweight on the luffing jib the weight of the crane construction remains relatively low, which makes it possible to drive with upward main boom.

According to the invention it is possible that the luffing jib is hingedly supported by a support frame which is adjustable along the main boom and which may be locked in the required position with respect to the main boom.

In this manner the luffing jib may be lowered when it is possible to work at a lower level, in which case the centre of gravity of the mobile crane will be positioned lower as well.

Preferably the main boom is provided at its top with a block of sheaves for a wire rope or the like, which engages the support frame for adjusting this frame along the main boom, if required.

Furthermore, a cabin can be connected to the support frame. In this embodiment it is possible that the cabin may be disconnected with respect to the support frame in the lowermost position and may be locked in this position.

The crane according to the invention is easy to mount on an existing mobile crane substructure which is equipped with a turntable and which carries the winches for luffing and hoisting.

The drawing shows several embodiments of the mobile crane according to the invention by way of example.

Figure 1:
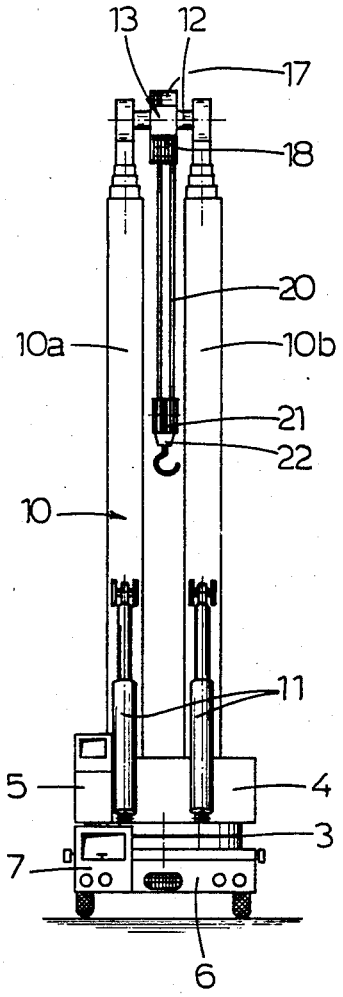
FIG. 1 is a front view of a first embodiment of the mobile crane according to the invention with retracted mast or main boom.
Figure 2:
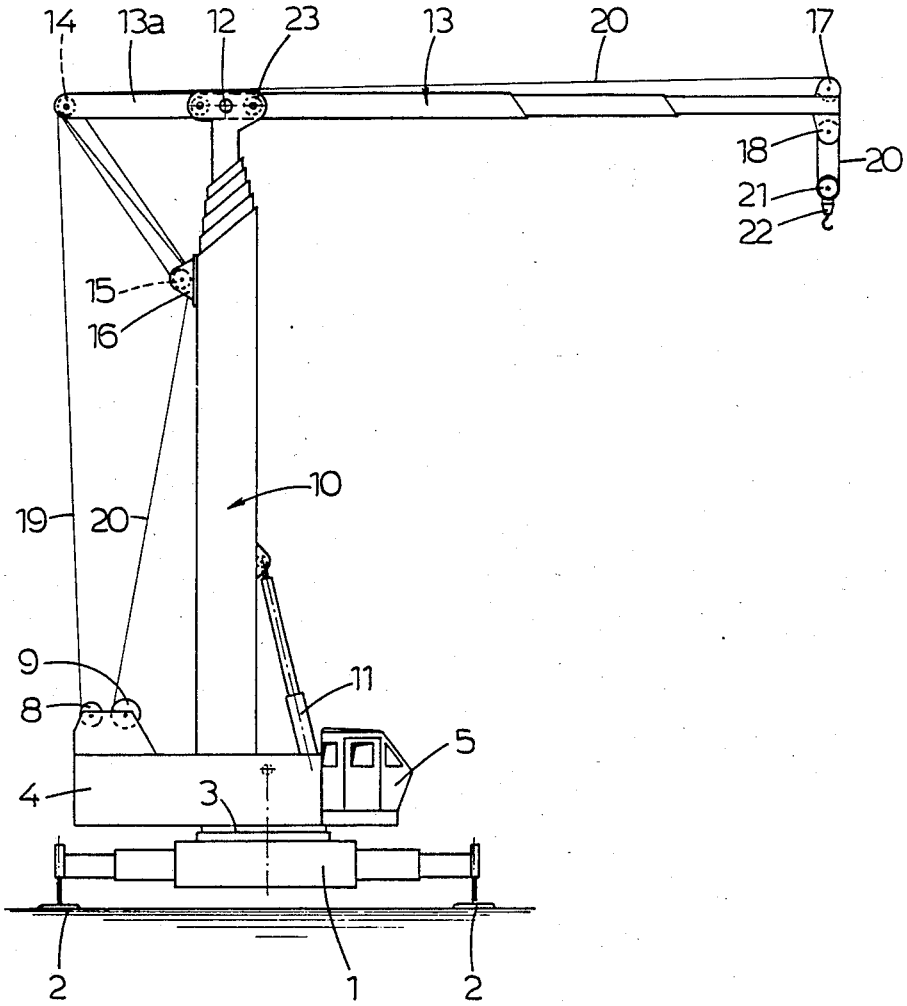
FIG. 2 is a side view of the crane of FIG. 1.
Figure 3:
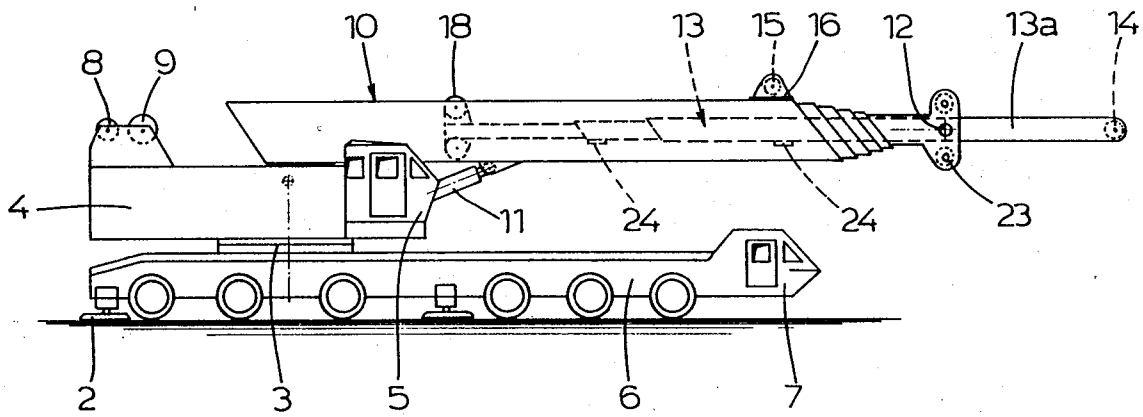
FIG. 3 is a side view of the crane of FIGS. 1 and 2 in the swung down transport position.

The mobile crane of FIGS. 1, 2 and 3 comprises a crane undercarriage of conventional construction with a substructure 1 provided with extendible outriggers 2 (shown in the working position in FIG. 2) and with a turntable 3, on which a frame 4 with a cabin 5 for the crane driver is supported. As shown in FIGS. 1 and 3 the substructure 1 can be positioned on an undercarriage 6 with a driver's cabin 7.

A hoist winch 9 and a luffing winch 8 as well as the drive motors for these winches and additional auxiliary equipment (not shown) are mounted on the frame 4 in a conventional manner. Furthermore, a hydraulic extendible main boom or mast 10 is hingedly connected to the frame 4 in a conventional manner as well. This main boom or mast 10 can be elevated from the transport position of FIG. 3 to a vertical position by means of two jacks 11 fitted at its front side, and, during operation, can also be luffed by these jacks. The main boom 10 is composed of two parallel boom parts 10*a*, 10*b* (FIG. 1), extending at a distance from each other, which are engaged by the jacks 11 and which are rigidly interconnected at the top side by a pivot shaft 12. A luffing jib 13 is supported on this pivot shaft 12. This luffing jib 13 is hydraulically extendible and retractable and continues rearwardly beyond the pivot shaft 12 for some distance with a luffing jib part 13*a*. The distance between the main boom parts 10*a* and 10*b* is such that the luffing jib 13 can be accommodated between these parts (FIGS. 1 and 3). The luffing jib part 13*a* carries a block of sheaves 14 at its rear side while a block of sheaves 15 is supported by the main boom 10 and is mounted in a bracket 16, which is preferably adjustable along the main boom 10 (in a manner not shown). The luffing jib 13 carries hoist sheaves 17, 18 at its front side.

A wire rope 19, which serves for luffing the jib 13 extends from the luffing winch 8 to the sheaves 14, whereafter this wire rope is reeved with a required number of turns between these sheaves 14 and the sheaves 15 of the main boom 10, and is connected with its end to the rearside of the luffing jib part 13*a*. A hoist wire rope 20 extends from the hoist winch 9 to the sheaves 15 and after having passed a required number of turns between these sheaves 15 and the sheaves 14, the hoist wire rope 20 runs along the luffing jib 13 forwards to the sheaf 17, whereupon the hoist wire rope is reeved again in the required manner between the sheaves 18, supported by the luffing jib 13 and the sheaves 21 of a hook block 22.

The luffing jib 13 can be swung down entirely between the parts 10*a* and 10*b* of the main boom 10. In this position, if required, the main boom 10 can be luffed and used for hoisting purposes, in which case hoisting sheaves swung down position of the luffing jib 13 the crane can be easily moved with the main boom 10 in the upright position. If for the transport of the crane over larger distances the main boom 10 is placed in the swungdown position (FIG. 3) the luffing jib 13, which is accommodated between the boom parts 10*a* and 10*b* and which is fixed by means of a locking device 24 only takes up little extra room. Therefore it is not necessary to dismantle the luffing jib 13.

Figure 4:
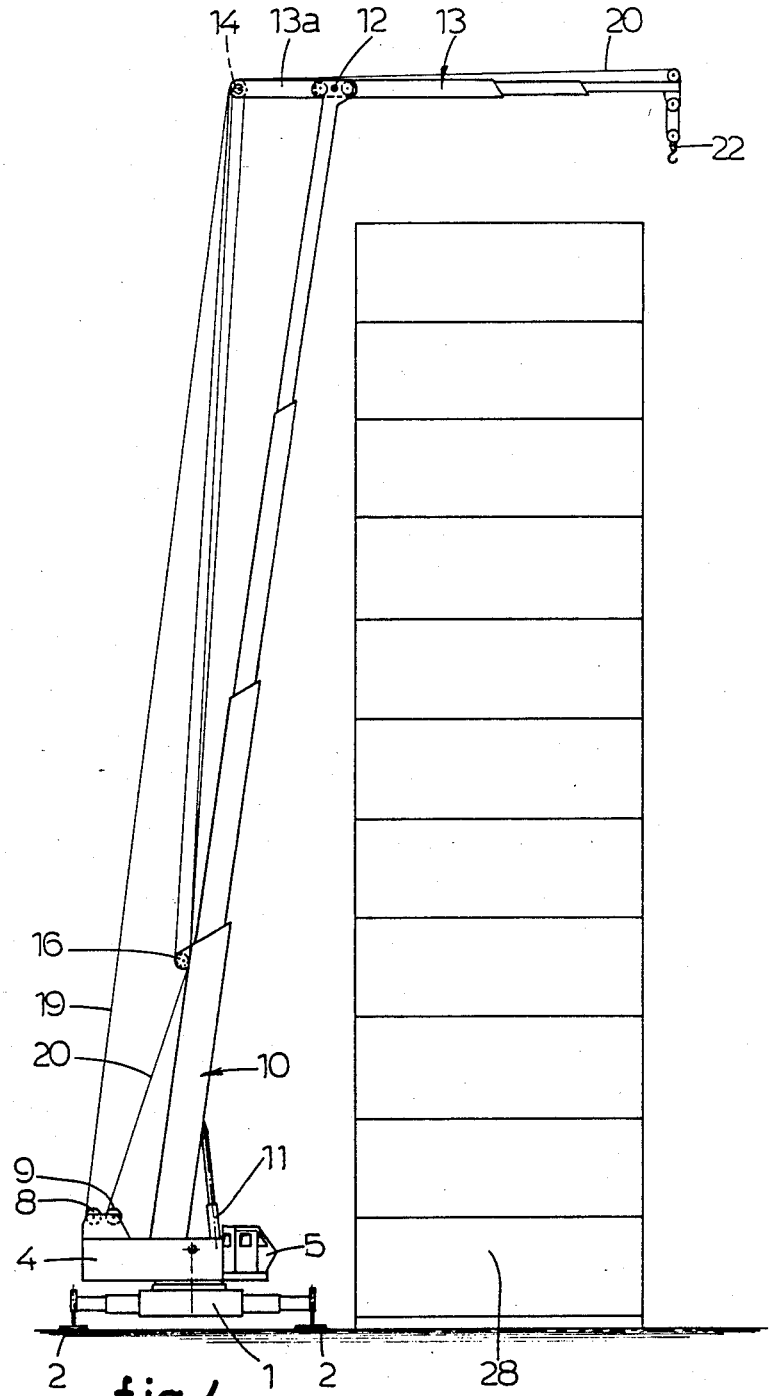
FIG. 4 illustrates on a smaller scale the application of the crane of FIG. 1 as a tower crane with extended boom.

FIG. 2 shows that the angle between the main boom 10 and the luffing jib 13 is entirely free at the front side. As shown schematically in FIG. 4 the crane can be placed very close to a building construction 28, with fully extended main boom 10, whilst the load can be moved in a horizontal direction, for instance by luffing the main boom 10.

Figure 5:
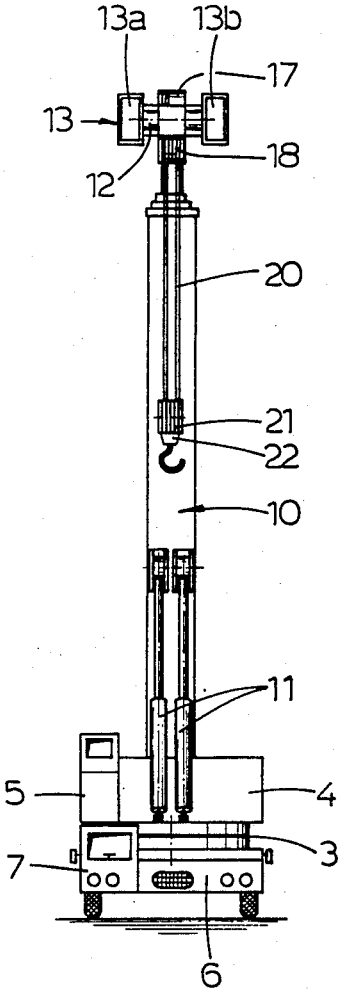
FIG. 5 is a similar front view as FIG. 1 of another embodiment of the crane.

FIG. 5 shows an embodiment of the crane which differs from the embodiment of FIGS. 1–3, because the hydraulically extendible main boom 10 is of a single construction, while the luffing jib 13 is composed of two interconnected luffing jib parts 13*a* and 13*b*, which extend at a distance from each other in such a manner, that these luffing jib parts can accommodate the main boom 10 between them. Again, the luffing jib 13 can be swung down into a position in which the centre lines of the main boom 10 and the luffing jib 13 at least substantially coincide, while the main boom 10 is in the upright position, whereafter the main boom 10 together with the luffing jib 13 can be swung down to the horizontal position for the transport of the crane. For the rest the mobile crane of FIG. 5 is similar to the mobile crane of FIGS. 1–3.

Figure 6:
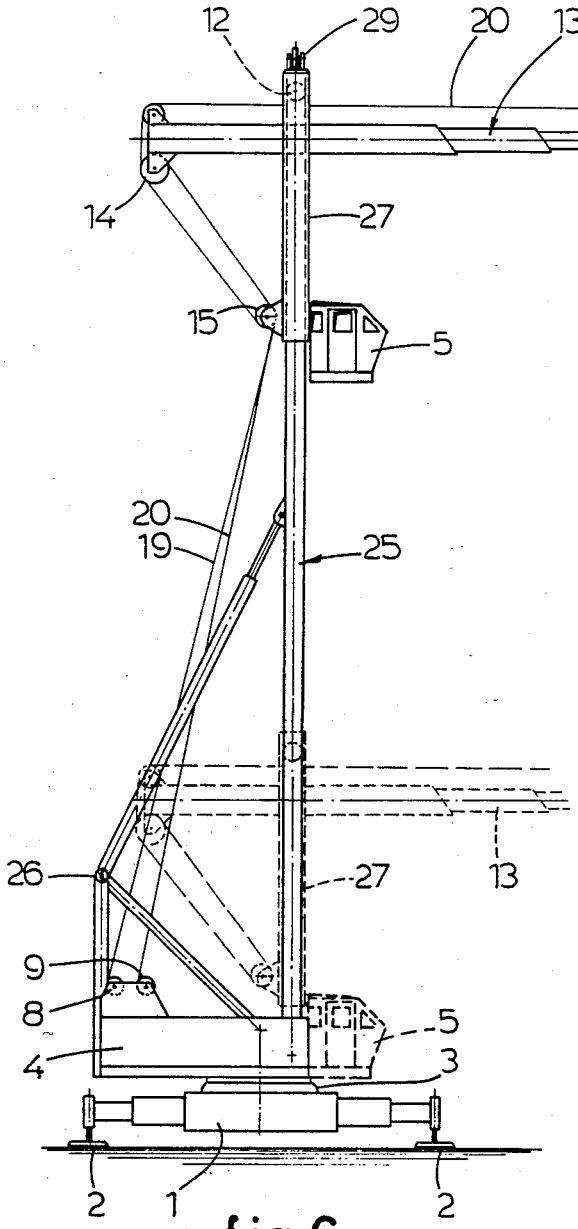
FIG. 6 is a side view of a third embodiment.

FIG. 6 shows another embodiment of the mobile crane according to the invention, wherein the substructure 1 with outriggers 2, the turntable 3, the frame 4 and the winches are again of the conventional construction as described hereinbefore. A main boom 25 is erected on the frame 4 and is supported in a known manner by a raking frame 26. The luffing jib 13 is hingedly supported by a support frame 27, which consists of a sleeve in the embodiment shown in the drawings. This support frame 27 is adjustable along the main boom 25 and may be locked at various heights with respect to the main boom 25, as is shown in dotted lines. The sheaves 15 are mounted on the support frame 27 as shown in the drawing, but may also be fitted to the foot of the main boom 25. The wire rope 19 and the hoist wire rope 20 which are wound on the winches 8 and 9, are reeved in a manner similar to that which is shown in FIG. 2. However, the wire rope 19 is now first passed over one of the sheaves 15. The cabin 5 can be connected to the support frame 27. In that case the cabin 5 is adjustable in height together with the support frame 27. It is possible, that the cabin 5 can be disconnected with respect to the support frame 27 in the lowermost position and may be locked in this position with respect to the main boom 25.

Figure 7:
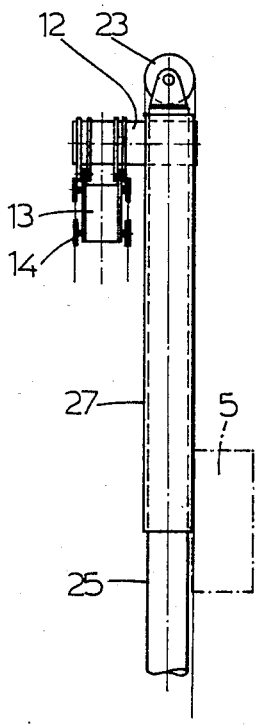
FIG. 7 is a partial rear view of the crane according to FIG. 6 on a larger scale and shows the support of the luffing jib by the main boom.

FIG. 7 is a detail of the crane according to FIG. 6 on a larger scale and shows the support of the luffing jib 13 by the main boom 25. Both the main boom 25 and the luffing jib 13 are of a single construction in the lateral direction, whereby the main boom 25 and the luffing jib 13 lie side by side in the swung down position. Further, the top of the main boom is provided with a block of sheaves 29 for a wire rope, which engages the support frame 27, in order to adjust the same along the main boom 25.

I claim:

1. Mobile crane with a main boom or mast, which can be brought in an upward position on a crane substructure, comprising an extendible and retractable luffing jib which is hingedly supported by the main boom and which can be positioned in a horizontal position, which luffing jib protrudes at its rear side over some distance beyond the main boom, whereby a first block of sheaves is fitted on the main boom at a lower level than the luffing jib while wire ropes are reeved between these sheaves and a second block of sheaves mounted on the rear end of the luffing jib for luffing the luffing jib as well as for hoisting.

2. Mobile crane according to claim 1, wherein the luffing jib is hingedly supported by a support frame which is adjustable along the main boom and which may be locked in the required position with respect to the main boom.

3. Mobile crane according to claim 2, wherein the main boom is provided at its top with a block of sheaves for a wire rope or the like, which engages the support frame.

4. Mobile crane according to claim 2, wherein a cabin can be connected to the support frame.

5. Mobile crane according to claim 4, wherein the cabin may be disconnected with respect to the support frame in a lowermost position and may be locked in this position.

6. Mobile crane according to claim 1, wherein the main boom and the luffing jib lie side by side in a swung down position.

7. Mobile crane according to claim 1, wherein the main boom or the luffing jib consists of two parallel parts which extend at a distance from each other and are interconnected by the pivot shaft between the main boom and the luffing jib, while these parts can accommodate the luffing jib or the main boom in the swung down position.

8. Mobile crane according to claim 1, wherein the main boom is provided at the top with its own block of sheaves for a wire rope.

9. Mobile crane according to claim 1, wherein the main boom is hydraulically extendible and luffable.

10. Mobile crane according to claim 9, wherein the first block of sheaves is mounted on a support frame.

11. Mobile crane according to claim 9, wherein the first block of sheaves is mounted in a bracket which is adjustable along the main boom.

* * * * *